US010372070B2

(12) United States Patent
Hazeyama

(10) Patent No.: US 10,372,070 B2
(45) Date of Patent: Aug. 6, 2019

(54) FUSER INCLUDING ROTATION BODY AND ENDLESS BELT

(71) Applicant: Brother Kogyo Kabushiki Kaisha, Nagoya-shi, Aichi-ken (JP)

(72) Inventor: Tomoaki Hazeyama, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/142,303

(22) Filed: Sep. 26, 2018

(65) Prior Publication Data

US 2019/0094771 A1 Mar. 28, 2019

(30) Foreign Application Priority Data

Sep. 27, 2017 (JP) ..... 2017-186927

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS

| | | | | |
|---|---|---|---|---|
| 8,706,014 | B2 | 4/2014 | Matsumoto | |
| 2005/0185996 | A1 | 8/2005 | Oishi et al. | |
| 2012/0057910 | A1 | 3/2012 | Matsumoto | |
| 2014/0199100 | A1* | 7/2014 | Seol | G03G 15/2053 399/329 |
| 2016/0238970 | A1* | 8/2016 | Miyauchi | G03G 15/2007 |
| 2016/0252860 | A1* | 9/2016 | Kadowaki | G03G 15/2053 399/331 |
| 2017/0031284 | A1* | 2/2017 | Ogawa | G03G 15/2053 |
| 2017/0090367 | A1* | 3/2017 | Kajita | G03G 15/2053 |
| 2017/0261900 | A1* | 9/2017 | Sawada | G03G 15/2053 |
| 2017/0315485 | A1* | 11/2017 | Tsunashima | G03G 15/2046 |
| 2017/0357204 | A1* | 12/2017 | Nishihara | G03G 15/80 |
| 2018/0032005 | A1* | 2/2018 | Sato | G03G 15/2053 |
| 2018/0059596 | A1* | 3/2018 | Eiki | G03G 15/2032 |
| 2018/0150005 | A1* | 5/2018 | Fujii | G03G 15/2028 |
| 2018/0299808 | A1* | 10/2018 | Suzuki | G03G 15/2053 |
| 2018/0335733 | A1* | 11/2018 | Matsuda | G03G 15/2017 |

FOREIGN PATENT DOCUMENTS

| | | |
|---|---|---|
| JP | 2005-275371 A | 10/2005 |
| JP | 2007-292948 A | 11/2007 |
| JP | 2012-058319 A | 3/2012 |

* cited by examiner

*Primary Examiner* — Sevan A Aydin
(74) *Attorney, Agent, or Firm* — Banner & Witcoff, Ltd.

(57) ABSTRACT

A fuser includes: a heater; a rotation body which is heated by the heater; an endless belt; an elastic pad which is in contact with an inner circumferential surface of the endless belt to form a nip portion with the endless belt intervening between the elastic pad and the rotation body; and a wall surrounded by the endless belt and disposed downstream of the elastic pad in a moving direction of the endless belt in the nip portion. The wall has a surface facing the elastic pad in the moving direction. The surface includes: contact portions positioned at both ends in a width direction of the endless belt and in contact with the elastic pad; and a center portion positioned between the contact portions in the width direction, at a downstream side of the contact portions in the moving direction.

11 Claims, 6 Drawing Sheets

END PORTION

CENTER PORTION

END PORTION

CENTER PORTION

END PORTION

CENTER PORTION

FUSER INCLUDING ROTATION BODY AND ENDLESS BELT

CROSS REFERENCE TO RELATED APPLICATION

The present application claims priority from Japanese Patent Application No. 2017-186927 filed on Sep. 27, 2017, the disclosure of which is incorporated herein by reference in its entirety.

BACKGROUND

Field of the Invention

The present invention relates to a fuser configured to fix or fuse a developer to a recording medium.

Description of the Related Art

There is conventionally known a fuser including a heating roller and a pressure pad that nips an endless belt between itself and the heating roller (see, Japanese Patent Application Laid-open No. 2007-292948). In that fuser, the pressure pad is made by using an elastic body, such as rubber. At the upstream end edge in a sheet conveyance direction of the pressure pad, both ends in a direction orthogonal to the sheet conveyance direction are positioned upstream, in the sheet conveyance direction, of the center portion. This allows both ends in a width direction of the sheet to be nipped between the pressure pad and the heating roller earlier than the center portion of the sheet, when the sheet has reached the fuser. This pulls each end in the width direction of the sheet outward in the width direction, smoothing wrinkles in the sheet. In that fuser, the downstream end surface in the sheet conveyance direction of the pressure pad is exposed and deformation of the downstream end surface in the sheet conveyance direction is not regulated uniformly.

SUMMARY

A fuser according to an aspect of the present teaching may include a heater, a rotation body configured to be heated by the heater, an endless belt, an elastic pad, and a wall. The elastic pad may be configured to be in contact with an inner circumferential surface of the endless belt and to form a nip portion with the endless belt intervening between the elastic pad and the rotation body. The wall may be surrounded by the endless belt and disposed downstream of the elastic pad in a moving direction of the endless belt at the nip portion. The wall may have a first surface facing the elastic pad in the moving direction. The first surface may include a first contact portion, a second contact portion, and a center portion. The first contact portion may be positioned at one end in a width direction and in contact with the elastic pad, the width direction being parallel to the endless belt in the nip portion and orthogonal to the moving direction. The second contact portion may be positioned at another end in the width direction and in contact with the elastic pad. The center portion may be positioned between the first contact portion and the second contact portion in the width direction, and downstream of the first contact portion and the second contact portion in the moving direction. The center portion may be out of contact with the elastic pad in a state where the fusing nip is not formed.

DESCRIPTION OF THE EMBODIMENTS

Figure 1:
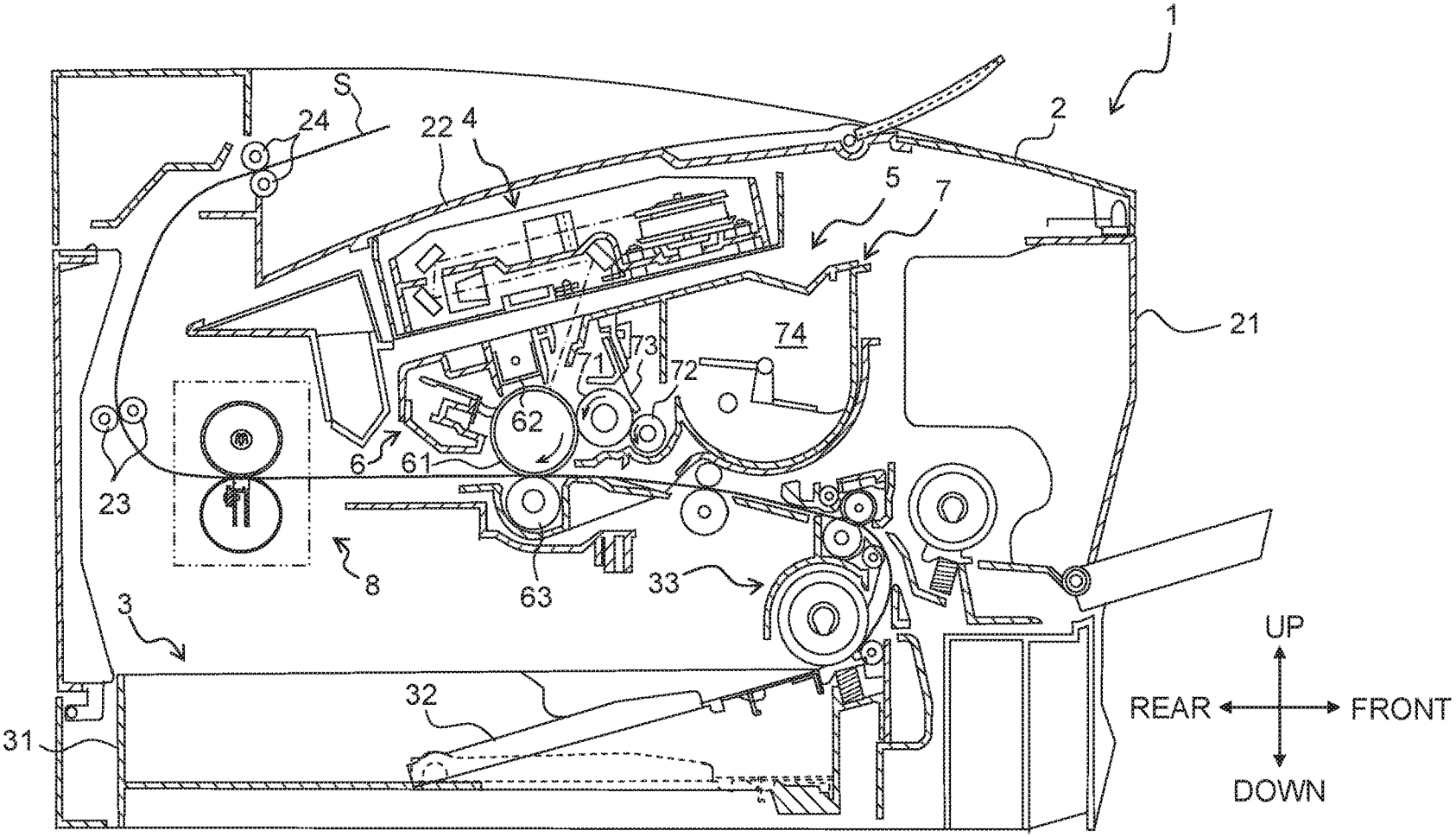
FIG. 1 is a cross-sectional view of an image forming apparatus including a fuser according to an embodiment of the present teaching.

An embodiment of the present teaching is described below in detail with reference to the drawings as appropriate. In the following, directions are defined as follows. That is, the right side in FIG. 1 is defined as the front, the left side in FIG. 1 is defined as the rear, the near side in FIG. 1 is defined as the left, and the far side in FIG. 1 is defined as the right. The up-down direction in FIG. 1 is defined as up and down.

As depicted in FIG. 1, a laser printer 1 includes a casing 2 that is mainly provided with a feed unit 3, an exposure apparatus 4, a process cartridge 5, and a fuser 8.

The feed unit 3, which is disposed in a lower part of the casing 2, mainly includes a feed tray 31 accommodating a sheet S, a sheet pressing plate 32, and a feed mechanism 33. The sheet pressing plate 32 moves the sheet S accommodated in the feed tray 31 upward and then the feed mechanism 33 supplies the sheet S toward the process cartridge 5.

The exposure apparatus 4, which is disposed in an upper part of the casing 2, includes a light source, a polygon mirror, a lens, a reflecting mirror, and the like (reference numerals thereof are omitted in the drawings). In the exposure apparatus 4, a light beam based on image data that is emitted from the light source is scanned on a surface of a photosensitive drum 61 at high speed. Accordingly, the surface of the photosensitive drum 61 is exposed.

The process cartridge 5 is disposed below the exposure apparatus 4. The process cartridge 5 is removably attached to the casing 2 through an opening of the casing 2 that appears when the front cover 21 is opened. The process cartridge 5 includes a drum unit 6 and a developing unit 7. The drum unit 6 mainly includes the photosensitive drum 61, a charger 62, and a transfer roller 63. The developing unit 7, which is removably attached to the drum unit 6, mainly includes a developing roller 71, a supply roller 72, a layer-thickness regulating blade 73, and a toner storage 74 storing a toner.

In the process cartridge 5, the surface of the photosensitive drum 61 is uniformly charged by the charger 62, then is exposed with the light beam from the exposure apparatus 4 to form an electrostatic latent image based on the image data on the photosensitive drum 61. The toner in the toner storage 74 is supplied to the developing roller 71 via the supply roller 72, enters between the developing roller 71 and the layer-thickness regulating blade 73, and is carried, as a thin layer having a certain thickness, on the developing roller 71. The toner carried on the developing roller 71 is supplied from the developing roller 71 to the electrostatic latent image formed on the photosensitive drum 61. This visualizes the electrostatic latent image (the electrostatic latent image is made as a visual image), and a toner image is formed on the photosensitive drum 61. Allowing the sheet S to pass between the photosensitive drum 61 and the transfer roller 63 transfers the toner image formed on the photosensitive drum 61 onto the sheet S.

The fuser 8 is disposed on the rear side of the process cartridge 5. When the sheet S passes the fuser 8, the toner image transferred on the sheet S is fused or fixed thereon. The sheet S to which the toner image is fused is discharged on a discharge tray 22 by using conveyance rollers 23 and 24.

Figure 2:
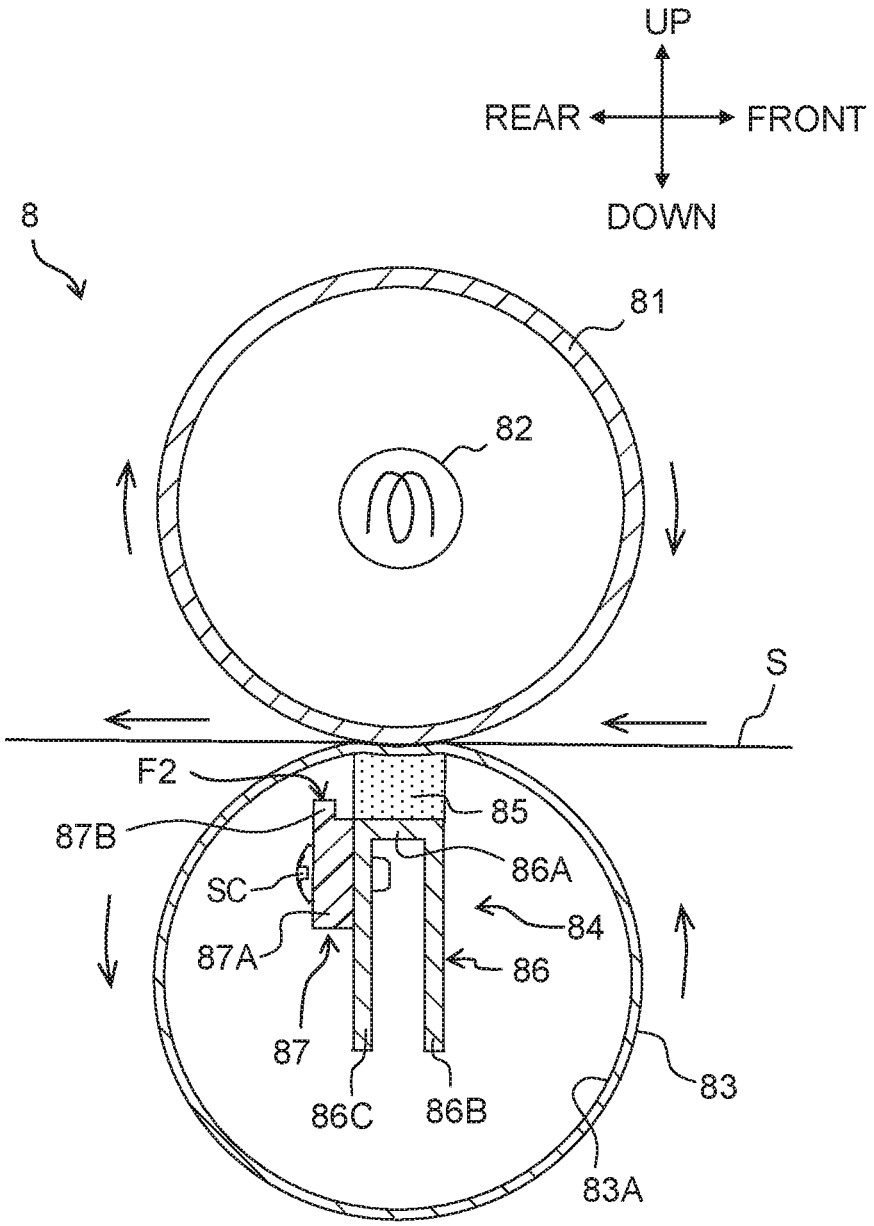
FIG. 2 is a cross-sectional view of the fuser.

As depicted in FIG. 2, the fuser 8 includes a heating roller 81 that is an exemplary rotation body, a heater 82, an endless belt 83, and a pressure unit 84. In the following, a width direction of the endless belt 83 is also simply referred to as a width direction, a moving direction of a part, of the endless belt 83, nipped between the heating roller 81 and the pressure unit 84 is also simply referred to as a moving direction, and a direction perpendicular to the moving direction and the width direction is also referred to as a first direction. In this embodiment, the width direction is along the left-right direction, the moving direction is along the front-rear direction, and the first direction is along the up-down direction.

The heating roller 81 is a cylindrical member. The heating roller 81 is made, for example, by forming a release layer, which is made using fluorine resin or the like, on the outer circumferential surface of a plain pipe, which is made using metal, such as aluminum. The heating roller 81 is rotatably supported by a frame of the fuser 8. The heating roller 81 is driven to rotate clockwise in FIG. 2 when receiving driving force from a motor provided in the casing 2 of the laser printer 1.

The heater 82, which heats the heating roller 81, is disposed inside the heating roller 81. As the heater 82, it is possible to use, for example, a halogen lamp that produces light by electric conduction and heats the heating roller 81 by radiation heat.

The endless belt 83 is a tubular member having flexibility. The endless belt 83 is made, for example, by forming a release layer, which is made using fluorine resin or the like, on the outer circumferential surface of a base member, which is made using, for example, metal such as stainless steel or resin such as polyimide resin. The endless belt 83 is driven to rotate counterclockwise in FIG. 2 due to the rotation of the heating roller 81.

An inner circumferential surface 83A of the endless belt 83 is coated with a lubricant, such as grease. This enhances slidability of the inner circumferential surface 83A of the endless belt 83 to the pressure unit 84, making it possible to rotate the endless belt 83 satisfactorily.

The pressure unit 84 is configured to have a nip state (see FIGS. 5A and 5B) in which the endless belt 83 is nipped between the pressure unit 84 and the heating roller 81. In the nip state, a nip portion may be formed between the outer circumferential surface of the heating roller 81 and the outer circumferential surface of the endless belt 83 by use of the pressure unit 84. The nip portion is positioned at an area corresponding to a part of the endless belt 83 sandwiched between the pressure unit 84 and the heating roller 81. The pressure unit 84 is also configured to have a nip release state (see FIGS. 6A and 6B) in which no pressure is applied between the pressure unit 84 and the heating roller 81. In the nip release state, the heating roller 81 may be in contact with the outer circumferential surface of the endless belt 83, and the inner circumferential surface 83A of the endless belt 83 may be in contact with the pressure unit 84. In that case, it may be preferable that no pressing force is applied between the pressure unit 84 and the heating roller 81. Specifically, the pressure unit 84 has the nip state by being urged by a spring toward the heating roller 81, and the pressure unit 84 has the nip release state by being pressed by a cam in a direction away from the heating roller 81 against the urging force of the spring. Alternatively, the pressure unit 84 may have the nip state by urging the heating roller 81 toward the pressure unit 84 by a spring, and the pressure unit 84 may have the nip release state by pressing the heating roller 81 by a cam in the direction away from the pressure unit 84 against the urging force of the spring.

Figure 3:
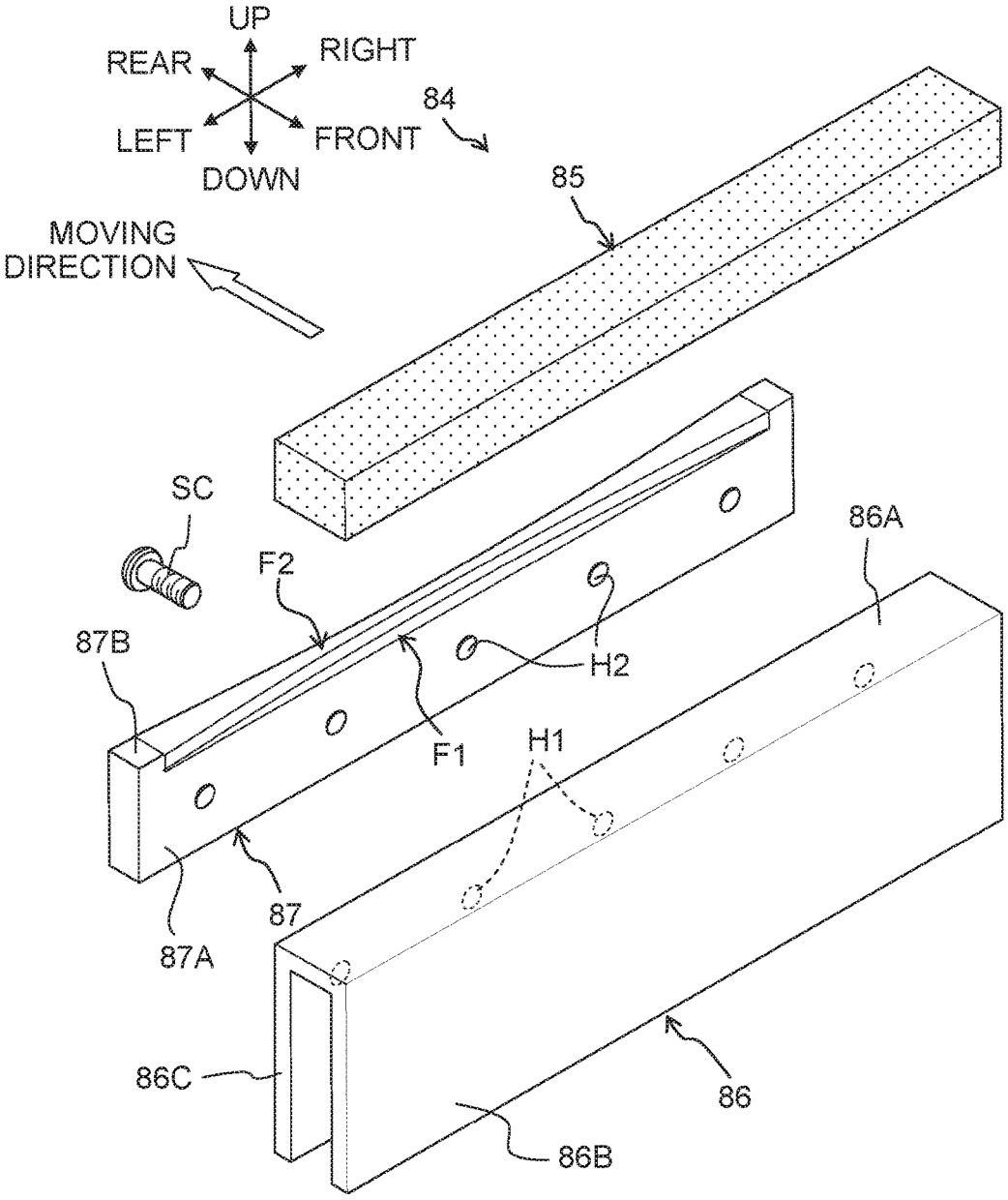
FIG. 3 is an exploded perspective view of a pressure unit.

As depicted in FIGS. 2 and 3, the pressure unit 84 includes the pressure pad 85, a stay 86, and a holder 87.

The pressure pad 85 is in contact with the inner circumferential surface 83A of the endless belt 83 to nip the endless belt 83 between itself and the heating roller 81. As depicted in FIG. 3, the pressure pad 85 has a rectangular parallelepiped shape that is long in the left-right direction. The pressure pad 85, which is made by using an elastic material such as rubber, is elastically deformable.

The stay 86 is a frame supporting the pressure pad 85. The stay 86 is made by using resin or metal. As depicted in FIG. 3, the stay 86 includes a base 86A to which the pressure pad 85 is secured, an upstream wall 86B extending from the upstream end in the moving direction of the base 86A along a direction away from the pressure pad 85, and a downstream wall 86C extending from the downstream end in the moving direction of the base 86A along the direction away from the pressure pad 85. The downstream wall 86C has holes H1. Screws SC are screwed into the holes H1, securing the holder 87 to the downstream wall 86C.

The holder 87 is made by using resin or metal. The holder 87 includes a base 87A that overlaps with the stay 86 in the moving direction, and a wall 87B that does not overlap with the stay 86 in the moving direction (see FIG. 2). The base 87A has holes H2 into which the screws SC are inserted.

The wall 87B, which extends beyond the base 86A of the stay 86 toward the heating roller 81, is disposed downstream of the pressure pad 85 in the moving direction. The wall 87B has such a height that the endless belt 83 is not nipped between the wall 87B and the heating roller 81. In this embodiment, the wall 87B is disposed away from the endless belt 83.

Figure 4A:
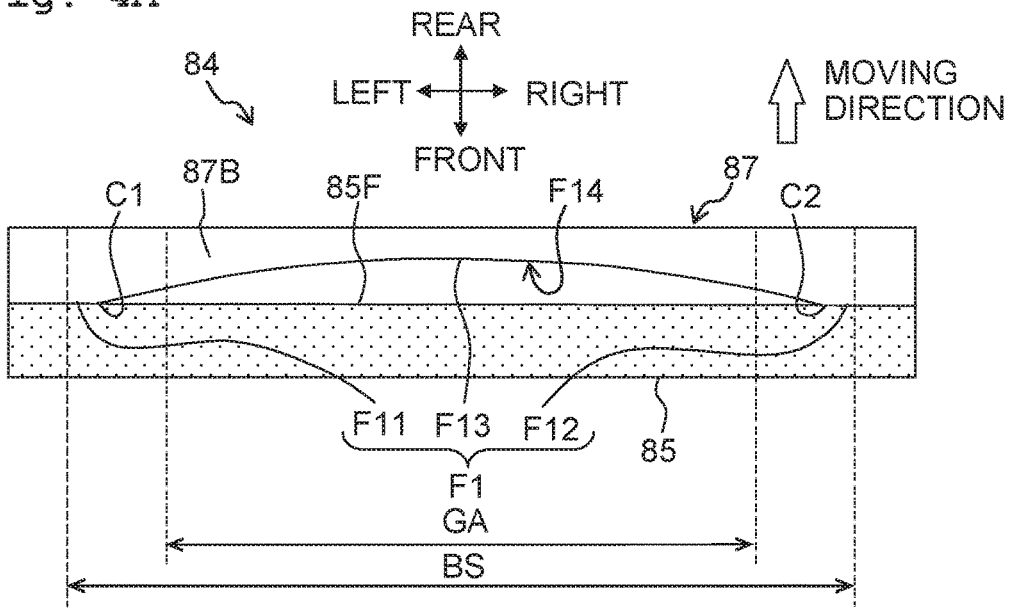
FIG. 4A is a top view of the pressure unit in a nip release state.

As depicted in FIG. 4A, the wall 87B has a surface F1 facing the pressure pad 85 in the moving direction. FIG. 4A depicts the nip release state in which the endless belt 83 is not nipped between the heating roller 81 and the pressure pad 85. In the nip release state, a facing surface 85F facing the wall 87B of the pressure pad 85, more specifically, the facing surface 85F facing the wall 87B in the moving direction is a flat surface orthogonal to the moving direction.

The surface F1 includes a contact portion F11 positioned on a first end side in the width direction, a contact portion F12 positioned on a second end side in the width direction, and a center portion F13 positioned in the center in the width direction. The contact portion F11 and the contact portion F12 are flat surfaces extending along the facing surface 85F of the pressure pad 85. The contact portion F11 and the contact portion F12 in the nip release state are in contact with the facing surface 85F of the pressure pad 85.

A part of the surface F1 between the contact portion F11 and the contact portion F12 is a curved surface F14 that continues from the first and second portions F11 and F12 and is concave toward the downstream side in the moving direction. In that configuration, the center portion F13, in the vicinity of the center of the surface F1, is positioned downstream of the contact portions F11 and F12 in the moving direction. The center portion F13 in the nip release state is not brought into contact with the pressure pad 85. In other words, the center portion F13 in the nip release state is separated from the facing surface 85F of the pressure pad 85.

The wall 87B has a corner C1 at a boundary between the contact portion F11 and the curved surface F14 and a corner C2 at a boundary between the contact portion F12 and the curved surface F14. The corner C1 and the corner C2 are positioned outside, in the width direction, an image formation area GA of a sheet having a largest size for which fusing can be performed by the fuser 8, and inside, in the width direction, a width BS of the sheet having the largest size. In other words, the corner C1 is positioned between a position P1 and a position P3, the position P1 and the position P3 being positions at which one side in the width direction of the sheet having the largest size and one side in the width direction of the image formation area GA pass respectively when the sheet having the largest size passes between the heating roller 81 and the endless belt 83. The corner C2 is positioned between a position P2 and a position P4, the position P2 and the position P4 being positions at which another side in the width direction of the sheet having the largest size and another side in the width direction of the image formation area GA pass respectively when the sheet having the largest size passes between the heating roller 81 and the endless belt 83.

Figure 4B:
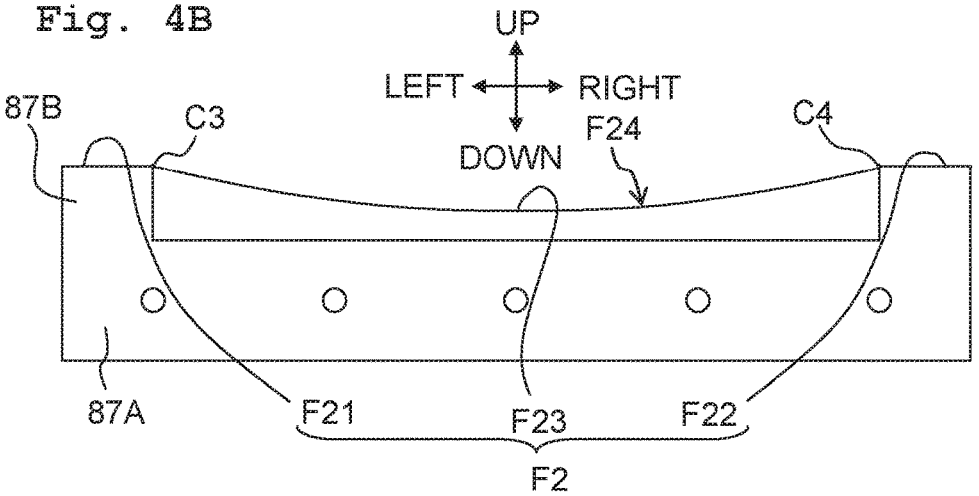
FIG. 4B is a front view of a holder.

As depicted in FIG. 4B and FIG. 2, the wall 87B has a surface F2 facing the heating roller 81 in the up-down direction (i.e., the first direction). Specifically, the surface F2 faces the heating roller 81 in the first direction, with the endless belt 83 intervening between itself and the heating roller 81. In other words, the surface F2 is a surface, of the surfaces of the wall 87B, facing the heating roller 81.

The surface F2 has an end F21 positioned on the first end side in the width direction, an end F22 positioned on the second end side in the width direction, and a center portion F23 positioned at the center in the width direction. The end F21 and the end F22 are flat surfaces perpendicular to the first direction.

Figure 5A:
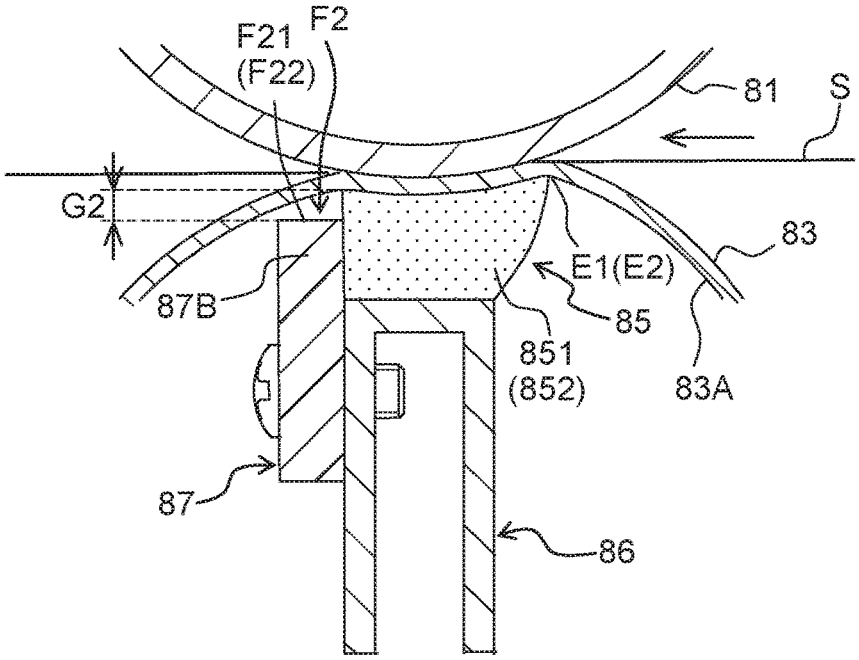
FIG. 5A depicts a cross-section of an end in a width direction of the pressure unit in the nip state.
Figure 5B:
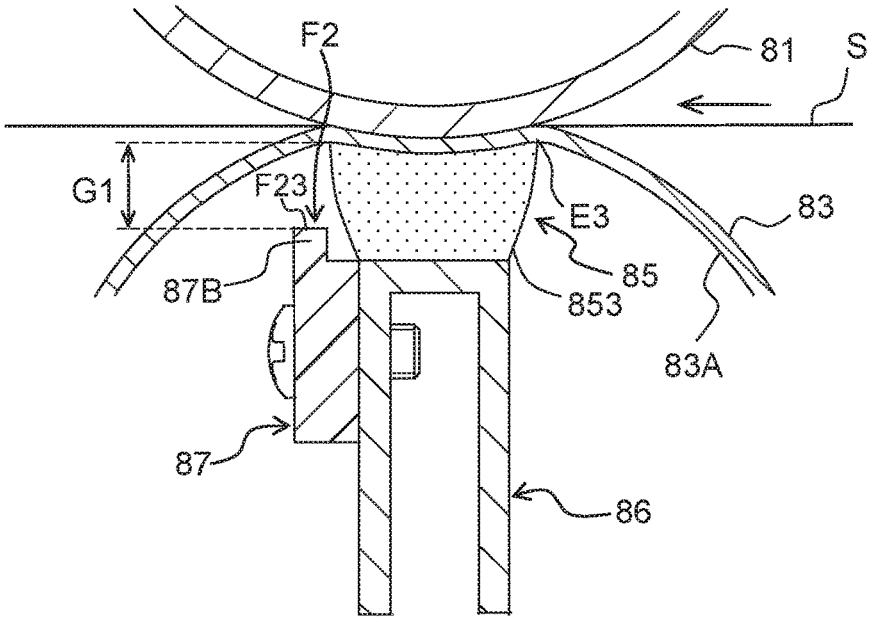
FIG. 5B depicts a cross-section of the center portion in the width direction of the pressure unit in the nip state.
Figure 6A:
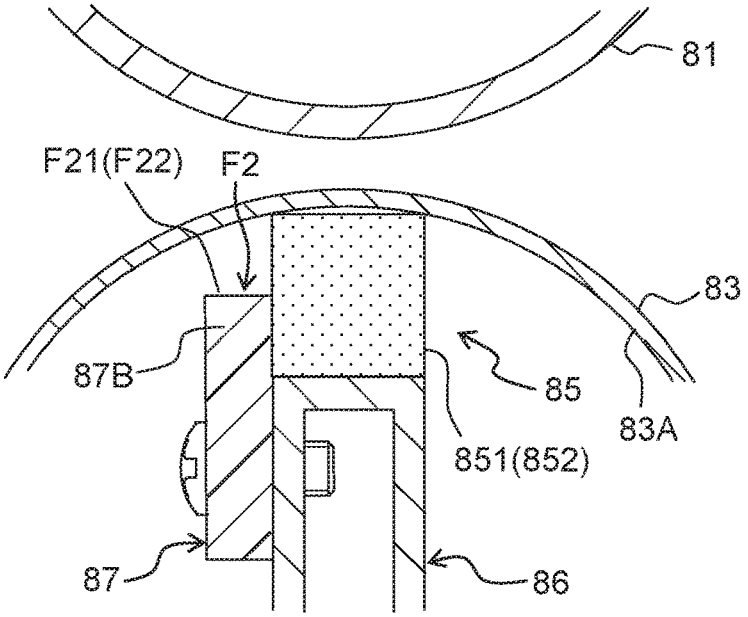
FIG. 6A depicts a cross-section of the end in the width direction of the pressure unit in the nip release state.
Figure 6B:
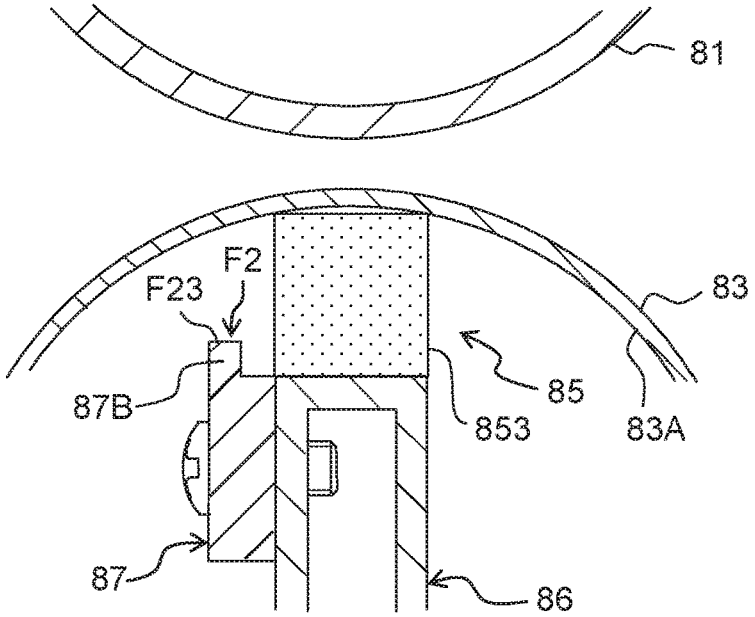
FIG. 6B depicts the cross section of the center portion in the width direction of the pressure unit in the nip release state.

A part of the surface F2 between the end F21 and the end F22 is a curved surface F24 that continues from the ends F21 and F22 and is concave downward, namely, toward the side away from the heating roller 81 in the first direction. In that configuration, the center portion F23 of the surface F2 is positioned on the lower side of the ends F21 and F22, namely, is positioned on the far side from the heating roller 81 in the first direction. In other words, as depicted in FIGS. 5A and 5B, a distance G1 in the first direction between the center portion F23 of the surface F2 and the inner circumferential surface 83A of the endless belt 83 is longer than a distance G2 in the first direction between the ends F21, F22 of the surface F2 and the inner circumferential surface 83A of the endless belt 83. The distances G1 and G2 each are a distance in the first direction between the upstream end edge in the moving direction of the surface F2 and the inner circumferential surface 83A of the endless belt 83. As depicted in FIGS. 5A and 5B, the wall 87B has: a center portion in the width direction including the center portion F23 of the surface F2; and end portions in the width direction including the ends F21, F22 of the surface F2 respectively. A cross-sectional area, of the center portion of the wall 87B, which is orthogonal to the width direction is smaller than a cross-sectional area, of each of the end portions of the wall 87B, which is orthogonal to the width direction.

As depicted in FIG. 4B, the wall 87B has a corner C3 at a boundary between the end F21 and the curved surface F24 and a corner C4 at a boundary between the end F22 and the curved surface F24. The corner C3 is disposed at the same position in the width direction as the corner C1 depicted in FIG. 4A, and the corner C4 is disposed at the same position in the width direction as the corner C2 depicted in FIG. 4A. Thus, the corner C3 and the corner C4 are positioned outside, in the width direction, the image formation area GA of the sheet having the largest size for which fusing can be performed by the fuser 8, and inside, in the width direction, the width BS of the sheet having the largest size.

As depicted in FIG. 5A, the end F21 and the end F22 in the nip state are separated from the endless belt 83. In the nip state, an end 851 in the width direction of the pressure pad 85 extends beyond the end F21 of the surface F2 toward the heating roller 81. In the nip state, an end 852 in the width direction of the pressure pad 85 extends beyond the end F22 of the surface F2 toward the heating roller 81.

Figure 4C:
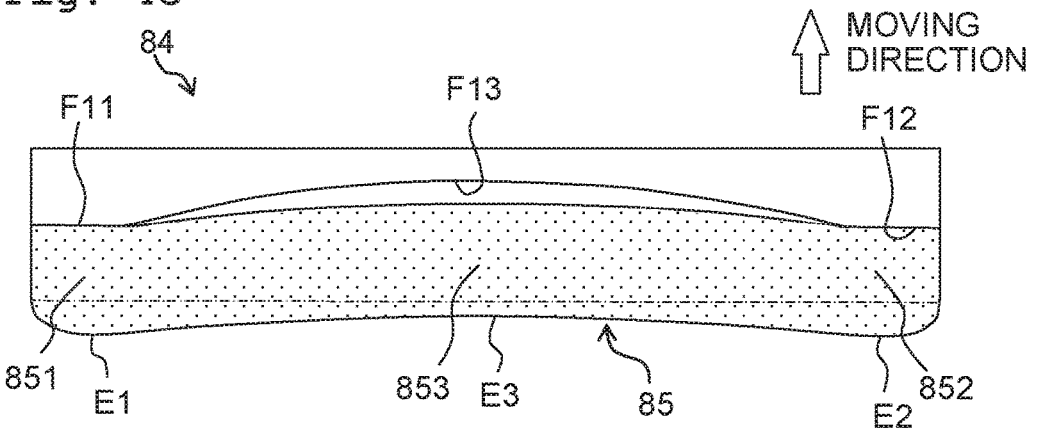
FIG. 4C is a top view of the pressure unit in a nip state.

Subsequently, explanation is made on the action and effect of the fuser 8 according to this embodiment. When the pressure unit 84 depicted in FIG. 4A is changed from the nip release state to the nip state, a center portion 853 of the pressure pad 85 is deformed to be convex toward the downstream side in the moving direction, as depicted in FIG. 4C. In this embodiment, in the nip state, the center portion 853 of the pressure pad 85 is separated from the wall 87B without any contact therewith. The deformation of the ends 851 and 852 of the pressure pad 85 toward the downstream side in the moving direction is regulated by the contact portions F11 and F12 of the wall 87B.

In that configuration, the ends 851 and 852 of the pressure pad 85 are positioned upstream of the center portion 853 in the moving direction, and thus end edges E1 and E2 of the ends 851 and 852 at the upstream side in the moving direction are positioned at the upstream side in the moving direction relative to an end edge E3 of the center portion 853 at the upstream side in the moving direction (see FIGS. 5A and 5B). Namely, the nip start positions of both ends of the pressure pad 85 are positioned upstream of the center of the pressure pad 85.

In the above configuration, when the sheet S has reached the fuser 8, both ends in the width direction of the sheet S can be nipped between the pressure pad 85 and the heating roller 81 earlier than the center portion thereof. This pulls the both ends in the width direction of the sheet S outward in the width direction, smoothing wrinkles in the sheet S.

This embodiment can obtain the following effects. The deformation of the pressure pad 85 is controlled by the shape of the surface F1 of the wall 87B. In that configuration, irrespective of the production error in the pressure pad 85, the nip start positions of both ends of the pressure pad 85 are positioned at the upstream side in the moving direction relative to the center of the pressure pad 85, thus preventing wrinkles in the sheet S.

The height of both ends in the width direction of the wall 87B is higher than that of the center portion of the wall 87B by making the distance between the center portion F23 of the surface F2 and the inner circumferential surface 83A of the endless belt 83 longer than the distance between the ends F21, F22 of the surface F2 and the inner circumferential surface 83A of the endless belt 83. In that configuration, the center portion 853 of the pressure pad 85 can be deformed to be convex toward the downstream side in the moving direction beyond a space above the center portion of the wall 87B. This makes it possible to further deform the center portion 853 of the pressure pad 85 to be convex toward the downstream side in the moving direction, making the nip starting position of the center portion 853 more downstream. The wrinkles in the sheet S are thus further prevented.

The part, of the surface F1, between the contact portion F11 and the contact portion F12 is the curved surface F14 continuing from the contact portions F11 and F12. This configuration can change a nip width and nip pressure continuously, preventing wrinkles in the sheet S more effectively than, for example, a case in which a concave in the first surface F1 has a stepped shape.

The parts, of the pressure pad 85, of which deformation is regulated by the corner C1 and the corner C2 of the wall 87B may badly affect an image formed in the image formation area GA. In this embodiment, however, the corners C1 and C2 are positioned outside the image formation area GA, preventing a situation in which the parts, of the pressure pad 85, of which deformation is regulated by the corner C1 and the corner C2 are pressed against the image formation area GA. This consequently prevents deterioration in image quality.

In the above configuration, the corners C1 and C2 are positioned inside the width BS of the sheet having the largest size. This allows the parts, of the pressure pad 85, of which deformation is regulated by the contact portions F11 and F12 to reliably apply the nip pressure to the both ends in the width direction of the sheet having the largest size, satisfactory preventing wrinkles in the sheet having the largest size.

In this embodiment, the pressure pad 85 has the rectangular parallelepiped shape, making it possible to reduce the production error in the pressure pad 85 and installation error when the pressure pad 85 is installed in the stay 86 more effectively than, for example, a case in which the pressure pad has a complicated shape.

The present teaching is not limited to the above embodiment, and can be used in a variety of embodiments described below. In the above embodiment, the pressure pad 85 has the rectangular parallelepiped shape. The present teaching, however, is not limited thereto. The pressure pad may have any other shape, for example, a shape similar to that of a conventional pressure pad. Specifically, in the upstream end edge in the moving direction of the pressure pad, both ends in a direction orthogonal to the moving direction may be positioned at the upstream side in the moving direction relative to the center.

In the above embodiment, in the nip state, the center portion 853 of the pressure pad 85 is not brought into contact with the wall 87B. The present teaching, however, is not limited thereto. For example, in the nip state, the center portion 853 of the pressure pad 85 may be brought into contact with the center portion F13 of the surface F1.

In the above embodiment, the halogen lamp is an example of the heater 82. The present teaching, however, is not limited thereto. The heater may be, for example, a carbon heater.

In the above embodiment, the heating roller 81 with the built-in heater is an example of the rotation body. The present teaching, however, is not limited thereto. The rotation body may be, for example, an endless heating belt of which inner circumferential surface is heated with a heater. Or, the heating system may be an external heating system, in which a heater is disposed outside the rotation body to heat the outer circumferential surface of the rotation body, or an Induction Heating (IH) system. Or, a heater may be disposed in the endless belt to heat the rotation body indirectly. Or, each of the rotation body and the endless belt may include a heater.

In the above embodiment, the wall 87B is formed in the holder 87 secured to the stay 86. The present teaching, however, is not limited thereto. For example, when a support member including a base that supports the pressure pad from below is provided, a wall extending from the base of the support member toward the heating roller may be formed.

In the above embodiment, the contact portion F11 and the contact portion F12 are the flat surfaces. The present teaching, however, is not limited thereto. The contact portion F11 and the contact portion F12 may be, for example, curved surfaces.

In the above embodiment, the part of the surface F1 between the contact portion F11 and the contact portion F12 is the curved surface F14 continuing from the contact portions F11 and F12. The present teaching, however, is not limited thereto. The part of the surface F1 between the contact portion F11 and the contact portion F12 may have any other shape provided that the part is concave toward the downstream side in the moving direction. Specifically, the part of the surface F1 between the contact portion F11 and the contact portion F12 may be a stepped recess or a V-shaped recess.

The respective elements explained in the embodiment and modified examples may be used in a combined manner.

What is claimed is:

1. A fuser, comprising:

a heater;

a rotation body configured to be heated by the heater;

an endless belt;

an elastic pad configured to be in contact with an inner circumferential surface of the endless belt and to form a nip portion with the endless belt intervening between the elastic pad and the rotation body; and a wall surrounded by the endless belt and disposed downstream of the elastic pad in a moving direction of the endless belt at the nip portion;

wherein the wall has a first surface facing the elastic pad in the moving direction, the first surface includes:

a first contact portion which is positioned at one end in a width direction and which is in contact with the elastic pad, the width direction being parallel to the endless belt in the nip portion and orthogonal to the moving direction;

a second contact portion which is positioned at another end in the width direction and which is in contact with the elastic pad; and a center portion which is positioned between the first contact portion and the second contact portion in the width direction, and downstream of the first contact portion and the second contact portion in the moving direction, and the center portion is out of contact with the elastic pad in a state where the nip portion is not formed.

2. The fuser according to claim 1, wherein the wall has a second surface facing the rotation body in a first direction, which is orthogonal to the moving direction and the width direction, wherein a distance in the first direction between a center of the second surface in the width direction and the inner circumferential surface of the endless belt is longer than a distance in the first direction between one end of the second surface in the width direction and the inner circumferential surface of the endless belt, and wherein the distance in the first direction between the center of the second surface in the width direction and the inner circumferential surface of the endless belt is longer than a distance in the first direction between another end of the second surface in the width direction and the inner circumferential surface of the endless belt.

3. The fuser according to claim 2, wherein an end of the elastic pad in the width direction is positioned, in the first direction, between one of the ends in the width direction of the second surface and the rotation body.

4. The fuser according to claim 2, wherein the second surface is a curved surface.

5. The fuser according to claim 1, wherein the first surface has a curved surface which is between the first contact portion and the second contact portion in the width direction and which continues from the first contact portion and the second contact portion.

6. The fuser according to claim 5, wherein the elastic pad includes a facing surface which faces the wall in the moving direction and which is flat, wherein the first contact portion and the second contact portion are flat surfaces along the facing surface, wherein the wall has: a first corner at a boundary between the first contact portion and the curved surface; and a second corner at a boundary between the second contact portion and the curved surface, wherein, in a case that a largest sheet acceptable for the fuser passes the nip portion, one side in the width direction of the largest sheet passes a first position of the nip portion, another side in the width direction of the largest sheet passes a second position of the nip portion, one side in the width direction of a largest image formation area of the largest sheet passes a third position of the nip portion, and another side in the width direction of the largest image formation area passes a fourth position of the nip portion, wherein the first corner of the wall is positioned between the first position and the third position of the nip portion in the width direction, and wherein the second corner of the wall is positioned between the second position and the fourth position of the nip portion in the width direction.

7. The fuser according to claim 2, wherein the wall has: a center portion in the width direction including the center of the second surface; one end portion in the width direction including the one end of the second surface; and another end portion in the width direction including the another end of the second surface, wherein a cross-sectional area, of the center portion of the wall, which is orthogonal to the width direction is smaller than a cross-sectional area, of the one end portion of the wall, which is orthogonal to the width direction, and wherein the cross-sectional area of the center portion of the wall is smaller than a cross-sectional area, of the another end portion of the wall, which is orthogonal to the width direction.

8. The fuser according to claim 1, wherein the elastic pad in a natural state has a rectangular parallelepiped shape.

9. The fuser according to claim 1, further comprising a stay configured to support the elastic pad and disposed on an opposite side of the rotation body with the elastic pad intervening between the stay and the rotation body, wherein the wall is secured to the stay with a screw.

10. The fuser according to claim 1, wherein the wall is out of contact with the endless belt in a state where the nip portion is formed.

11. The fuser according to claim 1, wherein the rotation body includes a plain pipe made by using metal, and the heater is disposed in the plain pipe.

* * * * *